US007686092B2

(12) United States Patent
Szarka

(10) Patent No.: US 7,686,092 B2
(45) Date of Patent: Mar. 30, 2010

(54) PLUG SYSTEMS AND METHODS FOR USING PLUGS IN SUBTERRANEAN FORMATIONS

(75) Inventor: David Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 128 days.

(21) Appl. No.: 11/611,407

(22) Filed: Dec. 15, 2006

(65) Prior Publication Data

US 2007/0102158 A1 May 10, 2007

Related U.S. Application Data

(63) Continuation-in-part of application No. 10/714,118, filed on Nov. 14, 2003, now Pat. No. 7,182,135.

(51) Int. Cl.
*E21B 33/12* (2006.01)

(52) U.S. Cl. ..... 166/386; 166/177.4; 166/179

(58) Field of Classification Search ..... None
See application file for complete search history.

(56) References Cited

U.S. PATENT DOCUMENTS

| | | | | |
|---|---|---|---|---|
| 4,250,966 | A * | 2/1981 | Streich et al. | 166/328 |
| 4,364,432 | A | 12/1982 | Bass et al. | 166/290 |
| 4,545,434 | A | 10/1985 | Higgins | 166/217 |
| 4,624,312 | A | 11/1986 | McMullin | 166/155 |
| 4,671,358 | A | 6/1987 | Lindsey, Jr. | 166/291 |
| 5,040,602 | A | 8/1991 | Helms | 166/285 |
| 5,718,287 | A | 2/1998 | Streich et al. | 166/66.6 |
| 5,722,491 | A | 3/1998 | Sullaway et al. | 166/291 |
| 5,787,979 | A | 8/1998 | Giroux et al. | 166/177.4 |
| 5,829,523 | A | 11/1998 | North | 166/250.14 |
| 6,082,451 | A | 7/2000 | Giroux et al. | 166/72 |
| 6,571,869 | B1 * | 6/2003 | Pluchek et al. | 166/177.4 |
| 6,799,638 | B2 | 10/2004 | Butterfield, Jr. | 166/386 |

(Continued)

FOREIGN PATENT DOCUMENTS

EP 0 697 496 A2 2/1996

(Continued)

OTHER PUBLICATIONS

Brochure Entitled "Landing Nipples and Lock Mandrels," From Otis Engineering Corp., General Sales Catalog, 1985.

(Continued)

*Primary Examiner*—Zakiya W. Bates
(74) *Attorney, Agent, or Firm*—John W. Wustenberg; Baker Botts, L.L.P.

(57) ABSTRACT

Methods and apparatus for subterranean well bore operations. An exemplary embodiment of a method is a method of activating a device in a subterranean well bore, the device having a baffle adapter configured to achieve sealing contact with a cementing plug, the cementing plug having an outer body and a detachable inner mandrel attached to the outer body, including the steps of: displacing the cementing plug into contact with the baffle adapter so that the outer body of the cementing plug achieves sealing contact with the baffle adapter; and applying a differential pressure across the cementing plug, thereby activating the device. An exemplary embodiment of an apparatus is a baffle adapter, having an inner bore designed to engage and seal against the outer body of a plug.

14 Claims, 6 Drawing Sheets

U.S. PATENT DOCUMENTS

| | | | | |
|---|---|---|---|---|
| 7,182,135 | B2 | 2/2007 | Szarka | |
| 2002/0174986 | A1 * | 11/2002 | Szarka | 166/289 |
| 2007/0102159 | A1 | 5/2007 | Szarka | |

FOREIGN PATENT DOCUMENTS

| | | | |
|---|---|---|---|
| EP | 0 846 839 | A2 | 6/1998 |
| EP | 0 869 257 | A2 | 10/1998 |

OTHER PUBLICATIONS

Halliburton Casing Sales Manual, Section 4.14, "SSR Plug Releasing Darts," Jul. 2003.

Foreign Communication From a Related Counterpart Application, Feb. 25, 2005.

Office Action dated Nov. 7, 2008 in U.S. Appl. No. 11/611,431.

* cited by examiner

PLUG SYSTEMS AND METHODS FOR USING PLUGS IN SUBTERRANEAN FORMATIONS

CROSS-REFERENCE TO RELATED APPLICATIONS

The present invention is a continuation-in-part of U.S. application Ser. No. 10/714,118 filed on Nov. 14, 2003, now U.S. Pat. No. 7,182,135, the entire disclosure of which is incorporated herein by reference.

BACKGROUND OF THE INVENTION

The present invention relates generally to subterranean well construction, and more particularly to plugs, plug systems, and methods for using these plugs and systems in subterranean wells.

Cementing operations may be conducted in a subterranean formation for many reasons. For instance, after (or, in some cases, during) the drilling of a well bore within a subterranean formation, pipe strings such as casings and liners are often cemented in the well bore. This usually occurs by pumping a cement composition into an annular space between the walls of the well bore and the exterior surface of the pipe string disposed therein. Generally, the cement composition is pumped down into the well bore through the pipe string, and up into the annular space. Prior to the placement of the cement composition into the well bore, the well bore is usually full of fluid, e.g., a drilling fluid. Oftentimes, an apparatus known as a cementing plug may be employed and placed in the fluid ahead of the cement composition to separate the cement composition from the well fluid as the cement slurry is placed in the well bore, and to wipe fluid from the inner surface of the pipe string while the cementing plug travels through it. Once placed in the annular space, the cement composition is permitted to set therein, thereby forming an annular sheath of hardened substantially impermeable cement therein that substantially supports and positions the pipe string in the well bore and bonds the exterior surface of the pipe string to the walls of the well bore.

In some circumstances, a pipe string will be placed within the well bore by a process comprising the attachment of the pipe string to a tool (often referred to as a "casing hanger and running tool" or a "work string") that may be manipulated within the well bore to suspend the pipe string in a desired location, including, but not limited to, suspension at or below the sea floor in off-shore operations. In addition to the pipe string, a sub-surface release cementing plug system comprising a plurality of cementing plugs may also be attached to the casing hanger and running tool. Such cementing plugs may be selectively released from the running tool at desired times during the cementing process. The sub-surface release cementing plug system may comprise a bypass mechanism that permits fluids to flow through the plugs at appropriate times. Conventional bypass mechanisms may comprise, for example, a rupture disk, which when punctured, may permit some degree of flow through the plug system. Additionally, a check valve, typically called a float valve, will be installed near the bottom of the pipe string. The float valve may permit the flow of fluids through the bottom of the pipe string into the annulus, but not the reverse. A cementing plug will not pass through the float valve. When a first cementing plug (often called a "bottom plug") is deployed from a sub-surface release cementing plug system and arrives at the float valve, fluid flow through the float valve is stopped. Continued pumping results in a pressure increase in the fluids in the pipe string, which indicates that the leading edge of the cement composition has reached the float valve and activates a by-pass mechanism built into the bottom plug. After the bottom plug has been opened, the cement composition flows through the float valve and into the annulus. When the top plug contacts the bottom plug which had previously contacted the float valve, fluid flow is again interrupted, and the resulting pressure increase indicates that all of the cement composition has passed through the float valve. It is important that all of the desired cement composition be pumped into the annulus from the pipe string. If not, the cement remaining in the pipe string will have to be drilled out before any further activities can take place. Furthermore, the annulus might not be properly filled with cement, and undesirable formation-fluid migration or failure of the pipe string may result. On the other hand, if the cement is overdisplaced, a lower portion of the annulus might not be properly filled with cement, and undesirable formation-fluid migration or failure of the pipe string could result. Overdisplacement of the cement is considered a worse problem than underdisplacement, as it can be more difficult to correct.

Sub-surface release cementing plug systems often have a number of difficulties. For example, a sub-surface release cementing plug system may be damaged when weight is transferred to it while it is being attached to the running tool and/or being inserted into the top of the casing. Such weight transfer may shear the bypass mechanism present in the bottom cementing plug; in such circumstance operations may be performed by removing the bottom plug and continuing the operation by relying solely on the top plug. Another problem is that conventional bypass mechanisms-when activated-may overly restrict the flow of a desired fluid through the cementing plugs. Flow restrictions are problematic because they may generate hydraulic ram effects against subterranean formations intersected by the borehole while the pipe string is being installed, which may result in complications such as hydraulic fracturing of the subterranean formation, for example, which may lead to problems such as lost circulation, differential sticking of the pipe string against the bore hole, loss of well control, difficulty or inability to place a cement composition at a desired location in the annular space, and other problems. Difficulties may also be encountered in releasing the plug sets in a timely and accurate fashion, to ensure that the bottom cementing plug is released in spacer fluid ahead of the leading edge of the cement slurry. The timely and accurate release of cementing plugs via a free fall device (e.g., weighted plastic balls) is particularly difficult in deep wells where the fluid capacity of the drill string may range up to about several hundred barrels. One attempt at solving this problem has been to use a cementing plug system wherein the bottom plug is released by the use of a positive displacement device, e.g., a drill pipe dart. However, this method has been problematic because the dart is captivated within the cementing plug once the plug has landed on the uppermost float valve near the bottom of the well bore and the bypass system has been activated, which may increase the length of the bottom plug and may restrict the flow rate through the bypass mechanism.

Cementing plugs must be drilled out of the casing when the cementing operation has been completed. For this reason, the plugs are usually made from materials that are easily drilled. Such materials include some kinds of plastic, aluminum, cast iron, and others. Although generally speaking plastic materials are easier to drill out than metal materials, they generally are subject to rapid erosion when exposed to conditions in the well.

Personnel conducting cementing operations often encounter a further problem in attempting to accurately determine the volume of the casing string prior to preparing the cement composition or to deploying a final ("top") cementing plug. This problem is typically caused by the fact that casing capacity tables are based upon nominal casing inner diameters for a given casing size and weight. Actual casing inner diameters often tend to be slightly larger than these published nominal inner diameters. Accordingly, on long casing strings the actual casing displacement can be significantly larger than the calculated theoretical volume, which may inhibit operators from displacing the final cementing plug to its desired shut-off point—e.g., from reaching and contacting the preceding cementing plugs atop the uppermost float valve near the bottom of the casing. This often prevents the customer from conducting a casing integrity test at the completion of cementing operations, and may result in extended drill out times due to excessive volumes of cement remaining inside the casing.

An additional problem often encountered with conventional cementing operations relates to the conventional configuration of float valves typically installed at the leading end of casing installed in a well bore. Typically, such float valves have an opening that is relatively small in relation to the inner diameter of the casing. In certain circumstances wherein the casing is disposed horizontally, such as when the casing is installed in a horizontal well, for example, sediment may accumulate along the bottom of the horizontally disposed casing. When a bottom cementing plug is displaced through the well bore, the plug may encounter an amount of sediment that is sufficient to slow the cementing plug's velocity and stop the cementing plug short of landing against the float valve and sealing against the entire diameter of the casing. This is problematic because the failure of the cementing plug to seal prevents operations personnel from conducting a pressure test on the casing. Furthermore, the problem becomes increasingly problematic as casing diameter increases, because a greater amount of sediment may accumulate due to factors such as decreased fluid velocities (which may permit debris to fall out of suspension) for a given rate of circulation, and because the relatively small inner diameter of conventional float valves in relation to the casing diameter forces the bottom cementing plug to displace the sediment to a greater height in order to propel it through the inner diameter of the float valve, when the casing is disposed horizontally. Sediment may build in front of the bottom plug until the pressure differential required to sustain plug movement exceeds the "opening" pressure of the plug (e.g., the pressure at which the bypass mechanism is activated). At this time cement flow will be established through the plug and over the top of the horizontal, accumulated sediment bed resident between the bottom plug and the upper float valve. When the top cementing plug at the tail of the cement slurry is displaced to the bottom plug, both plugs will continue to displace and push the cement and sediment ahead of the plugs until such time as the compacted sediment prevents the plugs from achieving sealing contact with the upper float valve. The inability of the cementing plugs to establish sealing contact with the float valve will prevent achievement of a pressure shut-off. Accordingly, contaminated cement and sediment may fill the remaining casing below the upper float and/or pass around the end of the casing string, thereby producing what is often referred to as a "wet shoe." Operators will have no surface indication that the plugs have failed to displace all debris through the float valve, because the landing pressure of the top plug will generally be much greater than the activation pressure of the bottom plug by-pass mechanism. Accordingly, the only indication that a problem exists may be the failure to properly land the top plug, along with the resulting "soft drill out" and/or the failure to achieve an acceptable shoe test after drill out.

SUMMARY OF THE INVENTION

The present invention relates generally to subterranean well construction, and more particularly, to plugs, plug systems, and methods for using these plugs and systems in subterranean wells.

An example of a method of the present invention is a method of activating a device in a subterranean well bore, the device comprising a baffle adapter configured to achieve sealing contact with a cementing plug, the cementing plug comprising an outer body and a detachable inner mandrel attached to the outer body, comprising: displacing the cementing plug into contact with the baffle adapter so that the outer body of the cementing plug achieves sealing contact with the baffle adapter; and applying a differential pressure across the cementing plug, thereby activating the device.

An example of an apparatus of the present invention is a baffle adapter, comprising an inner bore designed to engage and seal against the outer body of a plug.

The features and advantages of the present invention will be readily apparent to those skilled in the art upon a reading of the description of the preferred embodiments, which follows.

BRIEF DESCRIPTION OF THE DRAWINGS

A more complete understanding of the present disclosure and advantages thereof may be acquired by referring to the following description taken in conjunction with the accompanying drawing, wherein.

Figure 1:
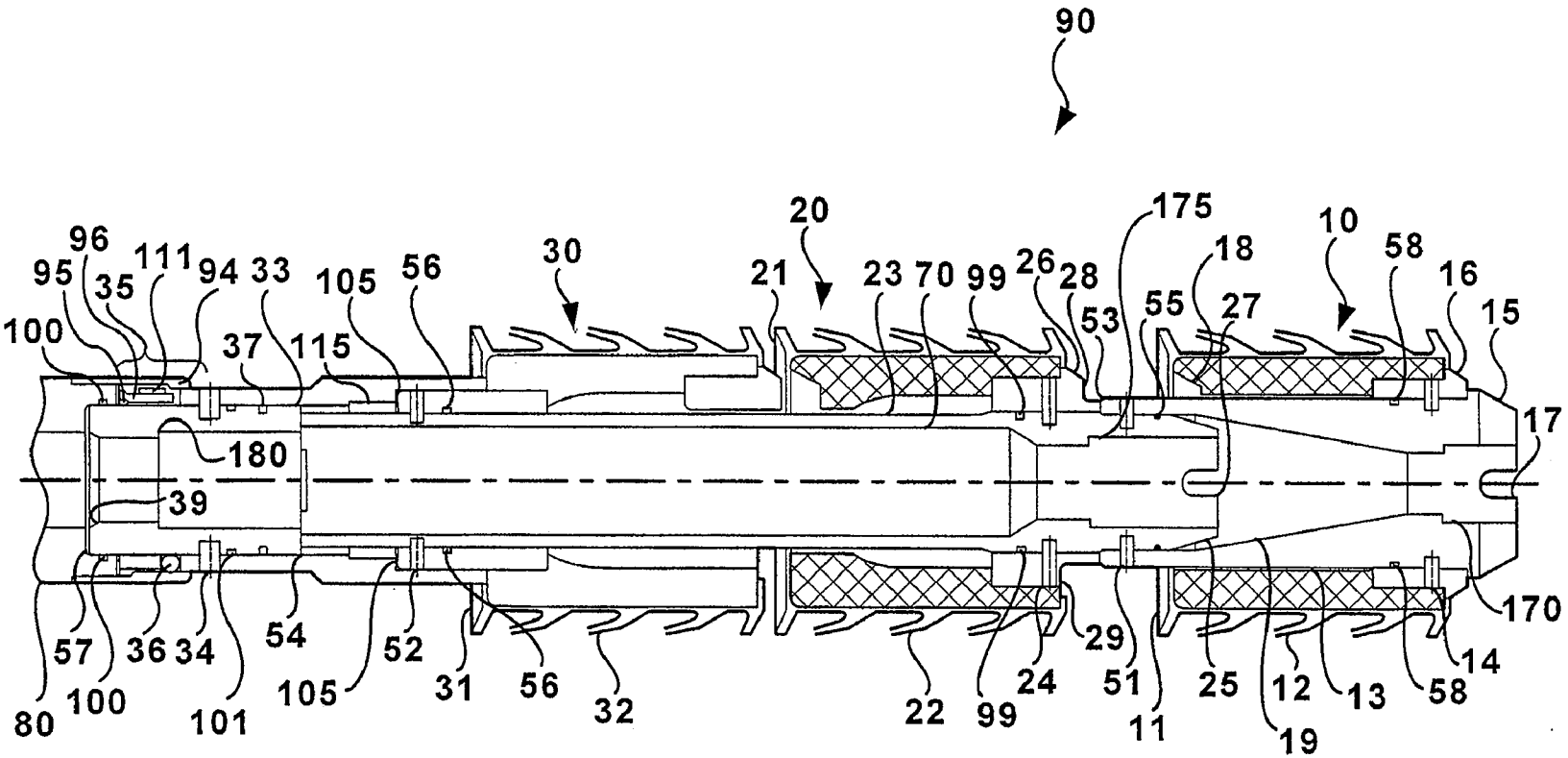
FIG. 1 is a side cross-sectional view of an exemplary embodiment of a three-plug cementing plug system of the present invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF EXEMPLARY EMBODIMENTS

The present invention relates generally to subterranean well construction, and more particularly, to plugs, plug systems, and methods for using these plugs and systems in subterranean wells. The cementing plugs of the present invention may be placed within a subterranean well bore in a cementing plug assembly comprising multiple cementing plugs.

An individual cementing plug may be detached from a cementing plug assembly, and subsequently deployed within the well bore, by contacting the plug with a releasing device 701; the interaction between the releasing device 701 and a particular plug interrupts fluid flow through the work string and casing, causing a pressure increase sufficient to cause the plug to detach from the assembly. A variety of releasing devices may be used in conjunction with the cementing plug systems of the present invention. Certain exemplary embodiments of the cementing plugs of the present invention may accept a weighted free fall device (such as a weighted ball, for example) as a releasing device. Certain other exemplary embodiments of the cementing plugs of the present invention may accept a positive displacement device (for example, a dart) as a releasing device.

An exemplary embodiment of a cementing plug assembly 90 of the present invention is shown in FIG. 1. A first bottom cementing plug is denoted generally by the numeral 10. First bottom cementing plug 10 comprises outer body 11. Wiper fins 12 are shown disposed along outer body 11. In certain exemplary embodiments, wiper fins 12 may be of the floppy or foldable type; such floppy or foldable wiper fins 12 may be particularly useful in tapered casing strings, for example. First bottom cementing plug 10 also comprises receiving portion 18; in certain exemplary embodiments, receiving portion 18 is tapered (as illustrated in the top half of FIG. 1). Tapering of receiving portion 18 may permit the cementing plug systems of the present invention to support higher pressures and higher loads during casing integrity tests, among other benefits. First bottom cementing plug 10 further comprises nose 16, depicted at a leading end of outer body 11.

Figure 7:
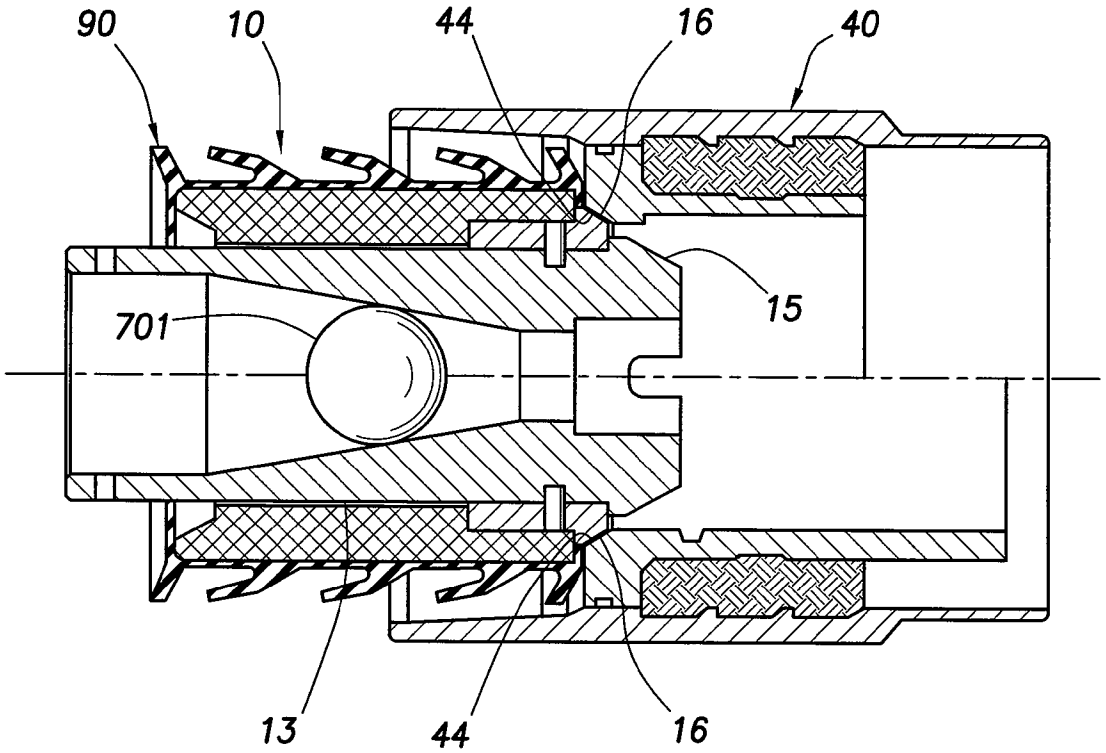
FIG. 7 is a side cross-sectional view of an exemplary embodiment of a cementing plug engaged and sealed against a baffle adapter of the present invention.

Detachable inner mandrel 13 is sealed to first bottom cementing plug 10 by seal 58, and is held in place within outer body 11 by frangible devices 14. Any type of frangible device may be suitable for use, including shear pins, shear rings, controlled strength glue joints, and the like. At a leading end of inner mandrel 13 is depicted nose 15, which nose 15 guides first bottom cementing plug 10 into baffle adapter 40 (shown in FIG. 3). In certain exemplary embodiments, nose 15 may be tapered in such a way as to guide first bottom cementing plug 10 into baffle adapter 40 so that nose 16 of outer body 11 seals against receiving portion 44 (shown in FIG. 3) of baffle adapter 40. In certain exemplary embodiments, both nose 16 of outer body 11 and receiving portion 44 of baffle adapter 40 may be tapered for positive sealing against each other (shown in FIG. 7). Among other benefits, positive sealing of nose 16 against receiving portion 44 may permit the cementing plug systems of the present invention to support higher pressures during operations such as conducting optional casing integrity testing. In certain exemplary embodiments, nose 15 comprises longitudinal slots 17, which ensure that inner mandrel 13 does not obstruct flow at certain times during deployment of the cementing plugs of the present invention.

Inner mandrel 13 further comprises inner bore 19. In certain exemplary embodiments, inner bore 19 may have an inner diameter identical to that of other inner mandrels in the cementing plug assembly; in such exemplary embodiments, inner bore 19 may be configured with a unique receiving profile (such as single lobe unique receiving profile 160 or double lobe unique receiving profile 165 in FIG. 2, for example), designed to permit a particular releasing device (e.g., a dart having a nosepiece comprising a matching unique key profile) to locate and lock within it. In certain exemplary embodiments, inner bore 19 may be tapered (as illustrated in FIG. 1) in such a way as to form a "seat" for a releasing device. In certain exemplary embodiments, inner bore 19 may be configured with a receiving profile designed so as to accept a latch-down mechanism on a releasing device (such as a dart having a nosepiece comprising a self-energized "C" ring); an example of such receiving profile may be seen at 170.

In certain exemplary embodiments, first bottom cementing plug 10 may require modifications, so as to permit a particular releasing device to be used; e.g., the length of first bottom cementing plug 10 may need to be altered, or inner bore 19 of inner mandrel 13 may need to be reconfigured, for example. One of ordinary skill in the art, with the benefit of this disclosure, will be able to recognize the appropriate modifications to be made to facilitate use of a particular intended releasing device.

A second bottom cementing plug is also shown in FIG. 1, and denoted generally by the numeral 20. Second bottom cementing plug 20 is attached to first bottom cementing plug 10 by frangible devices 51. Any type of frangible device may be suitable for use, including devices such as shear pins, shear rings, controlled strength glue joints, and the like. Second bottom cementing plug 20 comprises outer body 21, along which outer body 21 are disposed wiper fins 22. In certain exemplary embodiments, wiper fins 22 may be of the floppy or foldable type.

Detachable inner mandrel 23 is sealed to second bottom cementing plug by seal 99, and is held in place within outer body 21 by frangible devices 24. As noted above, any type of frangible device may be suitable for use, including shear pins, shear rings, controlled strength glue joints, and the like. At one end of inner mandrel 23 is depicted nose 25. When used in a system of cementing plugs, nose 25 of inner mandrel 23 guides second bottom cementing plug 20 into first bottom cementing plug 10; in certain exemplary embodiments, nose 25 may be tapered in such a way as to guide second bottom cementing plug 20 into first bottom cementing plug 10 such that nose 26 of outer body 21 seals against receiving portion 18 in first bottom cementing plug 10. In certain exemplary embodiments, both nose 26 of outer body 21 and receiving portion 18 in first bottom cementing plug 10 may be tapered for positive sealing against each other. In certain exemplary embodiments, nose 25 of inner mandrel 23 has longitudinal slots 27, which ensure that inner mandrel 23 does not obstruct flow at certain times during deployment of the cementing plugs of the present invention.

Inner mandrel 23 further comprises inner bore 70. Inner bore 70 may be configured to accept a variety of intended releasing devices, including but not limited to a weighted free fall device (such as a weighted ball) or a positive displacement device (such as a dart). For example, inner bore 70 of inner mandrel 23 may be tapered in such a way as to form a "seat" for a releasing device, and to seal against the releasing device. In certain other exemplary embodiments, inner bore 70 may be configured with a unique receiving profile (such as single lobe unique receiving profile 160 or double lobe unique receiving profile 165 in FIG. 2, for example) designed to permit a particular releasing device (e.g., a dart having a nosepiece comprises a matching unique key profile) to locate and lock within it. Certain exemplary embodiments of inner bore 70 may be configured with a receiving profile designed so as to accept a latch-down mechanism on a releasing device (for example, a dart having a nosepiece comprising a self-energized "C" ring); an example of such receiving profile may be seen at 175. One of ordinary skill in the art, with the benefit of this disclosure, will be able to recognize the appropriate modifications to be made to facilitate use of a particular intended releasing device.

Generally, the minor outside diameter of nose 15 of inner mandrel 13 of first bottom cementing plug 10, and nose 25 of inner mandrel 23 of second bottom cementing plug 20 will exceed the diameter of the opening in the float valve. Nose 15 and nose 25 may be configured in a variety of shapes. For example, nose 15 and nose 25 may be tapered. In certain other exemplary embodiments, nose 15 and nose 25 may alternatively have a rounded or "mule shoe" configuration. In certain exemplary embodiments, inner mandrel 13 of first bottom cementing plug 10, and inner mandrel 23 of second bottom cementing plug 20 may each have an overall length which exceeds the inside diameter of the casing to prevent inner mandrels 13 and 23 (once released from outer bodies 11 and 21, respectively) from inverting within the casing as they travel towards the float valve. Preventing a detached inner mandrel from inverting as it proceeds towards the float valve may ensure that the fluid stream flowing towards the float valve flows against the top of the inner mandrel and releasing device restrained therein; among other benefits, this may prevent the fluid stream from causing the premature release from such inner mandrel of a releasing device that does not comprise a latch-down mechanism.

Seal 55 seals first bottom cementing plug 10 to inner mandrel 23 of second bottom cementing plug 20. Seal 56 seals second bottom cementing plug 20 to top cementing plug 30. In certain exemplary embodiments, seal 55 has an equal or greater diameter than second seal 56. Among other benefits, this arrangement is useful during the stage of cementing operations when first bottom cementing plug 10 is released, as it may maintain inner mandrel 23 of second bottom cementing plug 20 under neutral or compressive loading during the hydraulic pressuring undertaken before the release of first bottom cementing plug 10, thereby minimizing the possibility of prematurely shearing frangible devices 24 and 52.

FIG. 1 further illustrates a top cementing plug, shown generally at 30. Top cementing plug 30 is attached to second bottom cementing plug 20 by frangible devices 52. Any type of frangible device may be suitable for use, including devices such as shear pins, shear rings, controlled strength glue joints, and the like. Top cementing plug further comprises outer body 31, along which wiper fins 32 are disposed. In certain exemplary embodiments, wiper fins 32 may be of the floppy or foldable type.

Inner sleeve 33 is sealed to top cementing plug 30 by seal 101. Inner sleeve 33 further comprises inner bore 39. In certain exemplary embodiments, inner bore 39 of inner sleeve 33 is tapered. Among other benefits, the tapering of inner bore 39 provides a "seat" for a releasing device. Among other benefits, the tapering of inner bore 39 also facilitates the passage through inner bore 39 of certain releasing devices by avoiding a square shoulder that could catch or damage such releasing devices upon their entry into inner bore 39. In certain other exemplary embodiments, inner bore 39 may be configured with a unique receiving profile (such as single lobe unique receiving profile 160 or double lobe unique receiving profile 165 in FIG. 2, for example) designed to permit a particular releasing device (e.g., a dart having a nosepiece comprises a matching unique key profile) to locate and lock within it. Certain exemplary embodiments of inner bore 39 may be configured with a receiving profile designed so as to accept a latch-down mechanism on a releasing device (for example, a dart having a nosepiece comprising a self-energized "C" ring); an example of such receiving profile may be seen at 180.

In certain exemplary embodiments, top cementing plug 30 further comprises lock mechanism 37. Lock mechanism 37 prevents inner sleeve 33 from moving backward in response to mechanical or hydraulic forces which may be encountered after inner sleeve 33 is activated by contact with a releasing device. In certain exemplary embodiments, lock mechanism 37 comprises a ring which may expand into internal upset 115 when inner sleeve 33 is displaced downward by a releasing device; shoulder area 105 stops the free downward travel of inner sleeve 33, permitting the ring to expand into internal upset 115, thereby preventing inner sleeve 33 from moving backward. In certain exemplary embodiments of the present invention, the incorporation of lock mechanism 37 within the cementing plugs of the present invention may, in combination with a second lock mechanism comprised within the releasing device (for example, a releasing dart having a nosepiece comprising a latch down feature) facilitates maintenance of the pressure integrity of the cementing plug system. For example, during events such as when top cementing plug 30 releases from work string 80, as well as events such as the release of pressure which may become trapped between top cementing plug 30 and an uppermost float valve, or events such as failure of the uppermost float valve, lock mechanism 37 may prevent inner sleeve 33 from dislodging from top cementing plug 30, and the lock mechanism within the releasing device may prevent the releasing device from dislodging from inner sleeve 33.

Inner sleeve 33 is held in place within outer body 31 by frangible devices 34. Any type of frangible device may be suitable for use, including but not limited to shear pins, shear rings, controlled strength glue joints, and the like. As illustrated in FIG. 1, the top cementing plugs of the present invention (such as top cementing plug 30, for example), may also be held in place within outer body 31 by a variety of "secondary" release mechanisms. Such secondary release mechanisms may be activated upon the movement of inner sleeve 33 to a "released" position arising from contacting of inner sleeve 33 with a releasing device such as a dart, a weighted free fall device such as a weighted ball, or other known releasing devices. For example, a collet-type secondary release mechanism, such as that denoted generally at 35, may be employed at the attachment of top cementing plug 30 to work string 80. Alternatively, a ball-type secondary release mechanism 36 may be used. In certain other exemplary embodiments where a secondary release mechanism is not used, the release mechanisms for each cementing plug may be frangible devices, such as shear pins, for example. Among other benefits, the use of release mechanisms in the top cementing plugs of the present invention may improve the reliability of the cementing plug system, because they permit top cementing plug 30 to be attached to work string 80 by multiple means—e.g., by both frangible device 34 as well as release mechanism 35 or 36.

The inner mandrels of the cementing plugs of the present invention may shoulder against each other in a manner that enables the cementing plug assemblies of the present invention to accept compressive loading without prematurely separating. Inner mandrel 13 of first bottom cementing plug 10, inner mandrel 23 of second bottom cementing plug 20, inner sleeve 33 of top cementing plug 30 and work string 80 shoulder against each other at shoulder areas 53, 54, and 57, respectively. This arrangement directs any compressive loads to which cementing plug assembly 90 might be subjected through inner mandrels 13 and 23 and inner sleeve 33, rather than direct such compressive loads into frangible devices 14, 24, 34, 51, or 52. Optionally, in certain exemplary embodiments, shoulder areas 53, 54, and 57 can be slotted to prevent the hydraulic sealing of inner mandrel 13 and nose 26 of second bottom cementing plug 20 to each other, to prevent the hydraulic sealing of inner mandrels 13 and 23 to each other, or to prevent the hydraulic sealing of inner mandrel 23 in second bottom cementing plug 20 to inner sleeve 33 in top cementing plug 30.

The cementing plugs of the present invention may employ a variety of sealing arrangements. For example, a conventional face seal arrangement is shown at 29. Optionally, certain exemplary embodiments of the cementing plug systems of the present invention may utilize a nose-seal arrangement, such as that shown at 28, which may be particularly suitable for high-pressure, high-temperature applications.

Figure 2:
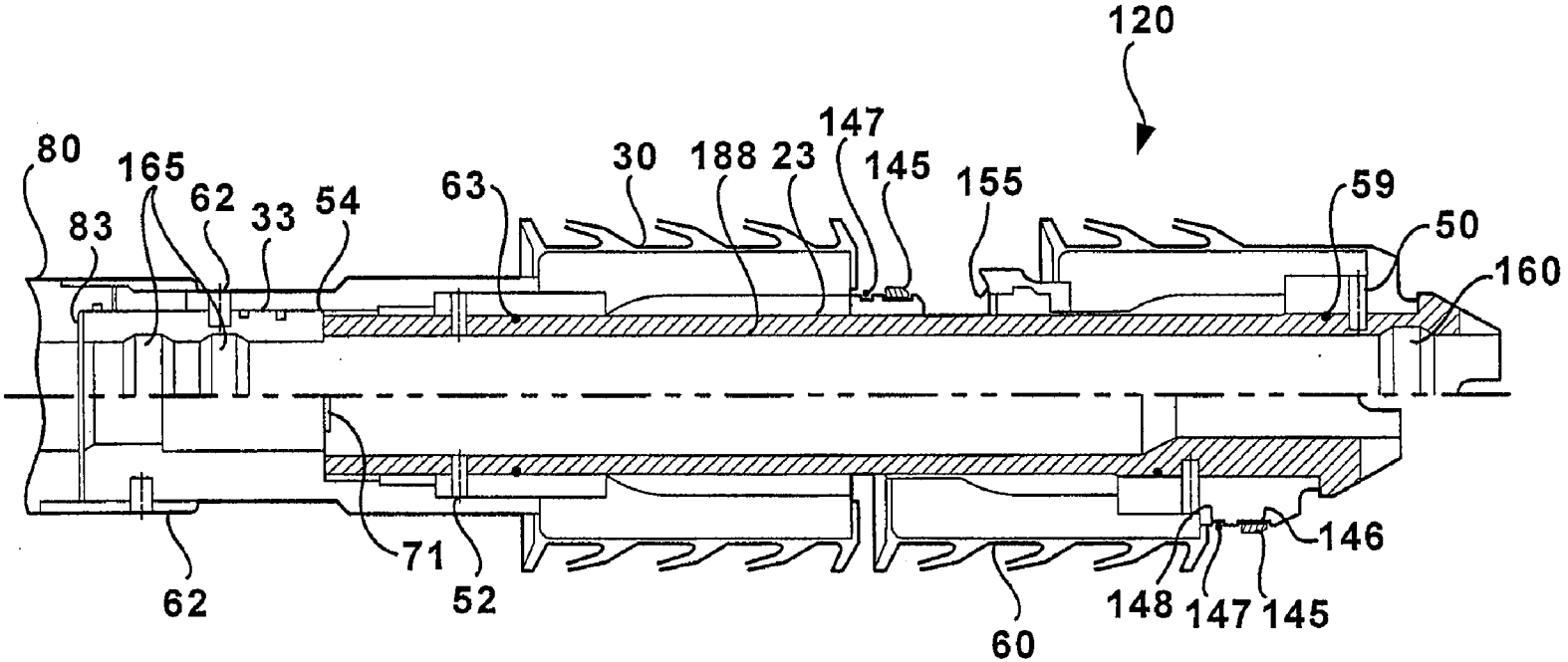
FIG. 2 is a side cross-sectional view of an exemplary embodiment of a two-plug cementing plug system of the present invention.

The cementing plug assemblies of the present invention may also be used as two-plug assemblies. Turning now to FIG. 2, an exemplary embodiment of a two-plug cementing plug assembly of the present invention is depicted therein, and denoted generally as 120. Bottom cementing plug 60 is attached to inner mandrel 23 by frangible devices 50, and is sealed to inner mandrel 23 by seal 59. Top cementing plug 30 is attached to inner mandrel 23 by frangible devices 52, and is sealed to inner mandrel 23 by seal 63. Inner mandrel 23 comprises inner bore 188. Inner mandrel 23, inner sleeve 33 of top cementing plug 30, and work string 80 shoulder against each other at shoulder areas 54 and 83, thus directing any compressive loads to which two-plug cementing plug assembly 120 might be subjected through inner mandrel 23 and inner sleeve 33, rather than directing such compressive loads into frangible devices 50, 52 and 62. Optionally, shoulder areas 54 and 83 may be configured to have a profile such that inner mandrel 23 is prevented from forming a face-to-face contact with inner sleeve 33 around their entire circumference, thereby preventing hydraulic sealing of inner mandrel 23 to inner sleeve 33. In certain exemplary embodiments, such face-to-face contact is prevented by adding longitudinal slots 71 to shoulder area 54 or 83. In certain exemplary embodiments, longitudinal slots 71 are sized no larger than necessary to permit a well bore fluid to pass between inner mandrel 23 and inner sleeve 33. In certain exemplary embodiments of the present invention, inner sleeve 33 has a unique receiving profile, such as double lobe unique receiving profile 165, for example, which may permit a particular releasing device to locate and lock within it. The bottom half of FIG. 2 also illustrates an exemplary embodiment wherein inner sleeve 33 is held in place within a top cementing plug (e.g., top cementing plug 30) solely by frangible devices (e.g., frangible devices 62) without employing a secondary release mechanism.

FIG. 2 also illustrates that the nose-seal arrangements employed by the cementing plugs of the present invention may be readily modified to include a latch-down feature, where desired. For example, in certain exemplary embodiments, a nose-seal arrangement may comprise latch 145; in such exemplary embodiments, a receiving configuration within, for example, a preceding cementing plug (e.g., receiving configuration 155 in bottom cementing plug 60) or within a baffle adapter (e.g., baffle adapter 40), for instance, will be configured with a profile so as to accept a latch down feature such as latch 145. Generally, latch 145 may comprise any self-energized device designed so as to engage and latch with a latch down receiving configuration, such as may be present in, for example, a cementing plug, or in a baffle adapter, for instance. In certain exemplary embodiments, latch 145 may comprise a self-energized "C" ring profile that may be attached to a cementing plug of the present invention by expanding the "C" ring profile over the major outer diameter of a nose of an outer body of a cementing plug, so as to lodge in groove 146 on such outer diameter. One of ordinary skill in the art, with the benefit of this disclosure, will be able to recognize an appropriate latch device for a particular application.

FIG. 2 further illustrates that the nose-seal arrangements employed by the cementing plug assemblies of the present invention may also, in certain exemplary embodiments, be fitted with one or more seal rings 147 (which may reside within groove 148) to enhance sealing. In certain exemplary embodiments of the present invention, seal rings 147 comprise elastomeric "O" rings; in certain of these exemplary embodiments, seal rings 147 may be made from a material such as a fluoro-elastomer, nitrile rubber, VITON™, AFLAS™, TEFLON™, or the like. In certain exemplary embodiments of the present invention, seal rings 147 comprise chevron-type "V" rings. One of ordinary skill in the art, with the benefit of this disclosure, will be able to recognize the appropriate type and material for seal rings 147 for a particular application.

Configuring each of the three cementing plugs, and baffle adapter 40 (shown in FIG. 3), with a sealed latch-down feature will, among other benefits, allow the deployed cementing plugs to act as a check valve, permitting the casing string to be installed in the well bore without a float valve. Among other benefits, such a "floatless" installation may be particularly useful in applications where casing is installed in tight well profiles where high ram forces may be encountered during casing installation. An example of a tight well profile is a well bore having an inner diameter that is only slightly larger than the outside diameter of the casing to be installed therein, or only slightly larger than the outside diameter of a casing coupling where threaded and coupled casing is used. Ram forces, e.g., the hydraulic frictional force created by the displacement of well fluids up through the annulus during the installation of casing into the well bore, generally vary proportionately with the clearance between the inner diameter of the well bore and the outer diameter of the casing or the casing coupling; accordingly, the smaller the clearance (such as in a tight well profile) the higher the ram force for a given rate of casing installation. Performing a "floatless" installation reduces the volume of well fluids which must be displaced up through the annulus, thereby desirably reducing the ram forces encountered during casing installation.

Figure 3:
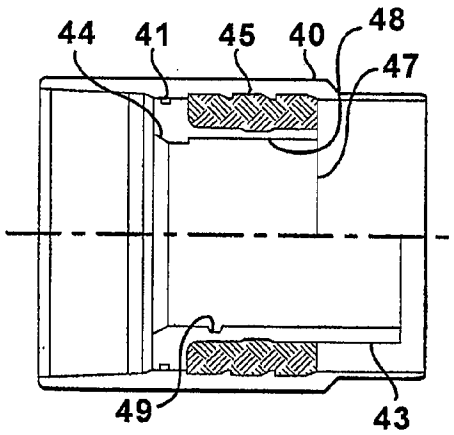
FIG. 3 is a side cross-sectional view of an exemplary embodiment of a baffle adapter of the present invention.
Figure 4:
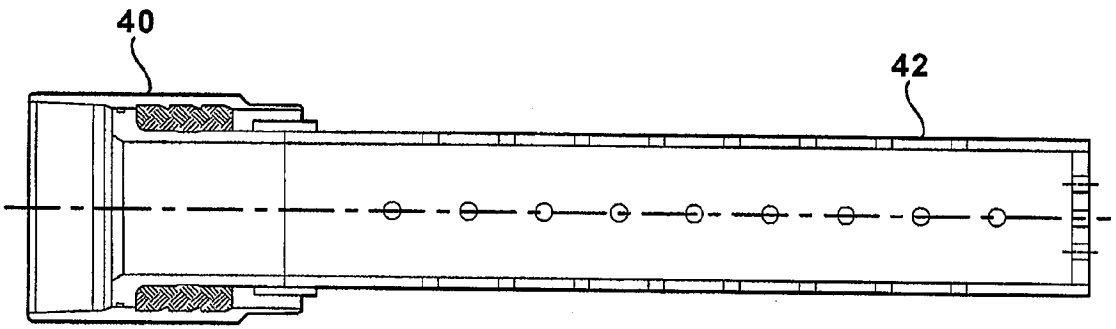
FIG. 4 is a side cross-sectional view of an exemplary embodiment of a baffle adapter and catcher tube of the present invention.

Turning now to FIGS. 3 and 4, FIG. 3 depicts an exemplary embodiment of a baffle adapter, denoted generally by numeral 40. Baffle adapter 40 may be used with three-plug cementing plug assembly 90 as well as with two-plug cementing plug assembly 120. Baffle adapter 40 further comprises an insert, which in preferred embodiments is sealed against the body of baffle adapter 40 by cement 45 and seal 41. Two alternative embodiments of the insert are depicted in FIG. 3. The upper half of the section of baffle adapter 40 depicts conventional length insert 47. The lower half of the section of baffle adapter 40 depicts extended length insert 43. In certain exemplary embodiments, extended length insert 43 is used, and extends and attaches to the inner diameter of optional perforated catcher tube 42, as illustrated in FIG. 4. In certain exemplary embodiments, the attachment of extended length insert 43 to optional perforated catcher tube 42 is by a threaded connection. In certain exemplary embodiments, baffle adapter 40 can also be configured to accept a latching mechanism on a bottom cementing plug (such as latch 145 depicted on bottom cementing plug 60 in FIG. 2, for example); in such embodiments, baffle adapter 40 may comprise a latch-down receiving profile (such as that illustrated in FIG. 3 at 48, for example) into which a latching mechanism may latch. In certain other exemplary embodiments, baffle adapter 40 may comprise a unique receiving profile such as single lobe unique receiving profile 49 in FIG. 3, for example. In certain exemplary embodiments where a bottom cementing plug having a tapered nose seal arrangement is used, receiving portion 44 may be tapered (as illustrated) so as to promote sealing with the tapered nose of the bottom cementing plug. Among other benefits, positive sealing of receiving portion 44 against baffle adapter 40 may permit the cementing plug systems of the present invention to support higher pressures during operations such as conducting optional casing integrity testing. Baffle adapter 40 has an inner diameter that is relatively wide compared to the inner diameter of the casing string with which it may be used. In certain exemplary embodiments, baffle adapter 40 has an inner diameter in the range of from about 70% to about 90% of the inner diameter of the casing string. Among other benefits, this improves the ability of the cementing plug assemblies of the present invention, comprising baffle adapter 40, to tolerate buildup of sediment within the casing before the initial displacement of bottom cementing plug 10. Further, as the cementing plug assemblies of the present invention are used with increasingly large casing strings, the inner diameter of baffle adapter 40 increases proportionately to the increase in the casing string inner diameter.

Optionally, the cementing plug systems of the present invention may comprise a single-plug cementing plug assembly. In certain exemplary embodiments of such single-plug assemblies, baffle adapter 40 may be configured to accept a latch-down mechanism on the cementing plug (such as latch 145, for example, shown in FIG. 2). In certain exemplary embodiments, such a single-plug assembly is used for a "floatless" casing installation wherein the minimum inner diameter of a work string, such as that exemplified by work string 80 in FIG. 1 or FIG. 2, is only slightly larger than the inner diameter of the releasing sleeve of the cementing plug, such as the releasing sleeve exemplified by inner sleeve 33 in FIGS. 1 and 2. In certain exemplary embodiments, inner sleeve 33 may comprise a unique receiving profile such as single lobe unique receiving profile 160 in FIG. 2, for example. Among other benefits, such an assembly may minimize the pressure drop across the single-plug cementing plug assembly during installation, thereby minimizing ram forces.

Figure 6:
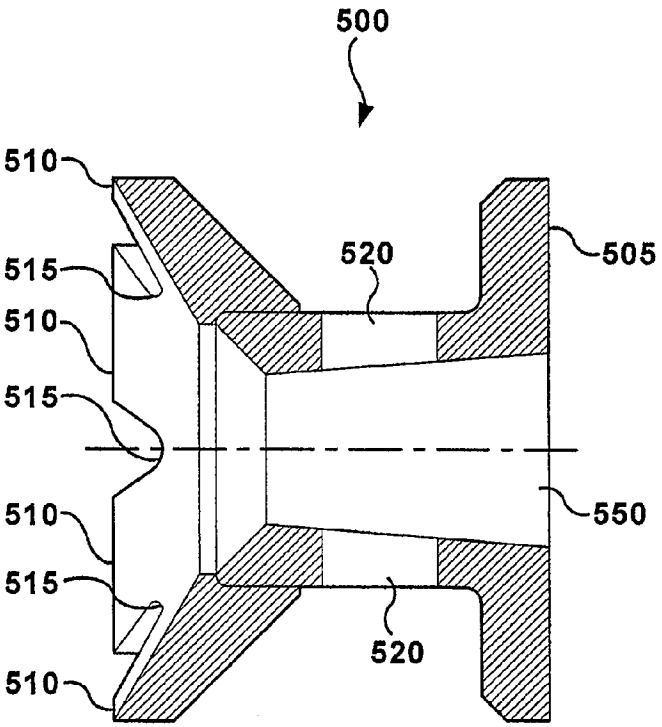
FIG. 6 is a side cross-sectional view of an exemplary embodiment of a bypass baffle, which may be used in accordance with the present invention.

In certain exemplary embodiments, a baffle adapter 40 may be installed in a casing string one or more casing joints above a float valve-and above an optional bypass baffle (such as bypass baffle 500, illustrated in FIG. 6, for example)-after which the casing string may be lowered into the well bore using a work string. In certain exemplary embodiments of the present invention wherein bypass baffle 500 is placed within a casing string, the centerline of bypass baffle 500 will be coincident with the centerline of the casing string. Generally, bypass baffle 500 may be placed within a casing string at a desired location so as to provide a desired amount of space between the top of a float valve and the leading end of an inner mandrel which may be landed atop bypass baffle 500. In certain exemplary embodiments, the bypass baffle may be located within a casing coupling above the float valve, or may be located such that solid bottom 505 rests atop the surface of the upper float valve. Among other benefits, the inclusion of a bypass baffle within a casing string may reduce potential turbulence in the fluid region above the float valve, thereby reducing any potential for erosion of the float valve which may exist. Where a detachable inner mandrel of a cementing plug of the present invention (e.g., detachable inner mandrel 13) is displaced downhole according to the methods of the present invention, the detachable inner mandrel may land atop bypass baffle 500—for example, between solid web segments 510. Fluid flowing through the casing string towards the float valve may flow around both the landed detachable inner mandrel and solid web segments 510 by flowing through slots 515 in between solid web segments 510. As the outer diameter of bypass baffle 500 may be relatively close to the inner diameter of the casing string, slots 515 may facilitate fluid in bypassing through the top section of bypass baffle 500, in order to enter the inner diameter of bypass baffle 500 through slots 520. Fluid may also enter the inner diameter of bypass baffle 500 by flowing through slots in the landed detachable inner mandrel (e.g., slots 17 in detachable inner mandrel 13). Fluid flowing through the inner diameter of bypass baffle 500 then exits through outlet 550.

Generally, a float valve will always be present within the casing string. However, in certain exemplary embodiments, the float valve may be unnecessary, for example where all cementing plugs have a sealed, latch-down nose (an example of which may be seen in FIG. 2, for example, comprising latch 145 and seal 147), thereby facilitating a "floatless" casing installation.

The following example describes one exemplary embodiment in which the present invention may be employed. At the interface between the work string and the casing within the well bore, a three-plug cementing plug assembly may be suspended. During well circulation activities prior to introducing a cement composition into the casing, operating personnel may introduce a releasing device, such as a weighted free fall device (e.g., a weighted ball) or a positive displacement dart, into the work string and allow such releasing device to interact with the three-plug cementing plug assembly. In certain exemplary embodiments where a dart is used as the releasing device, inner bore 19 of inner mandrel 13 is configured such that the dart becomes encapsulated within inner mandrel 13 after contact, and does not become dislodged when inner mandrel 13 separates from bottom cementing plug 10. In certain exemplary embodiments where a weighted ball is used as the releasing device, inner bore 19 of inner mandrel 13 is tapered such that, after inner mandrel 13 separates from bottom cementing plug 10, the weighted ball cannot become dislodged from inner mandrel 13 under normal circumstances. In this interaction, in one embodiment the releasing device passes through inner sleeve 33 of top cementing plug 30, through inner mandrel 23 of second bottom cementing plug 20, and lodges in inner bore 19 of inner mandrel 13 of first bottom cementing plug 10. In certain exemplary embodiments, inner bore 19 is tapered. The interaction of the releasing device in inner bore 19 of inner mandrel 13 interrupts fluid flow through the work string and casing, causing a pressure increase, which may in some circumstances be detectable by operating personnel, depending on factors such as whether the well bore is hydrostatically balanced at the time. When the internal casing pressure reaches a selected first differential pressure frangible devices 51 are sheared, releasing first bottom cementing plug 10 from second bottom cementing plug 20. In certain exemplary embodiments of the cementing plugs of the present invention, seal 55 has an equal or greater diameter than second seal 56. In certain exemplary embodiments, seals 100 and 101 have the same seal diameter, thereby balancing the pressure on inner sleeve 33, and preventing frangible devices 34 from being subjected to loading. Among other benefits, this arrangement maintains inner mandrel 23 of second bottom cementing plug 20 under neutral or compressive loading during the increase in pressure before the release of first bottom cementing plug 10, thereby minimizing the possibility of prematurely shearing frangible devices 24 and 52, which would prematurely deploy second bottom cementing plug 20 and inner mandrel 23 of second bottom cementing plug 20.

Having been released from second bottom cementing plug 20, first bottom cementing plug 10 travels down through the casing until it encounters baffle adapter 40, interrupting fluid flow once again and causing another pressure increase. This pressure increase signals the operating personnel that first bottom cementing plug 10 has traversed the length of the casing. The time difference between pressure increases, in conjunction with the known pumping rate, may be used by operating personnel to measure a volume of fluid in the system. For example, where a free fall device such as a weighted ball is used as the releasing device, the time difference between pressure increases may be used to measure the volume in the casing string. Where a positive displacement device such as a dart is used as the releasing device, the time difference between the release of the positive displacement device and pressure increases in conjunction with the known pumping rate may be used to measure the total volume of fluid in the system, e.g., the volume in the drill pipe plus the volume in the casing string. Among other benefits, the deployment of first bottom cementing plug 10 during circulation activities enables operating personnel to more accurately determine the amount of displacement fluid that will be necessary to properly displace the anticipated cement slurry by comparing the calculated casing volume based upon nominal inner diameters of the pipe string with the volume measured to have been actually displaced downhole between the two pressure increases. Operating personnel may then increase the differential pressure across seal 58 to a selected second differential pressure sufficient to shear frangible devices 14, release inner mandrel 13, and restore fluid flow through the relatively large inner diameter of outer body 11 of first bottom cementing plug 10. Inner mandrel 13 will fall through baffle adapter 40 onto a bypass baffle (e.g., bypass baffle 500, illustrated in FIG. 6) installed above the float valve or, alternatively, into perforated catcher tube 42. In either case longitudinal slots 17 in nose 15 of inner mandrel 13 assure that inner mandrel 13 does not substantially undesirably interfere with fluid flow. The inclusion of a bypass baffle above the float valve protects the float valve and minimizes potentially high fluid turbulence at the interface between nose 15 of inner mandrel 13 and the top of the float valve assembly.

When operating personnel subsequently introduce a cement composition into the work string, they also introduce a releasing device. In certain exemplary embodiments, the releasing device is a positive displacement releasing device, such as a dart, although other releasing devices, such as a weighted ball, may be used. Generally, the releasing device is pumped down through the work string at the leading edge of the cement composition. It then passes through top cementing plug 30, and lodges within inner bore 70 of inner mandrel 23 of second bottom cementing plug 20, thereby interrupting fluid flow. Next, the differential pressure may be increased across seal 56 to a selected third differential pressure, shearing frangible devices 52, and releasing second bottom cementing plug 20 from top cementing plug 30. In certain exemplary embodiments, the differential pressure may be increased across seal 56 naturally by virtue of the hydrostatic imbalance across the releasing device; in certain other exemplary embodiments, the differential pressure may be increased by actions taken by operating personnel. The cement slurry is pumped down through the casing with second bottom cementing plug 20 at its leading edge until second bottom cementing plug 20 contacts, and seals against, first bottom cementing plug 10 which had previously contacted and sealed against baffle adapter 40. Fluid flow is again interrupted. Differential pressure across seal 99 may then be increased to a selected fourth differential pressure, thereby shearing frangible devices 24 and releasing inner mandrel 23 from outer body 21 of second bottom cementing plug 20. This reestablishes fluid flow through the relatively large cross-sections of outer body 21 of second bottom cementing plug 20 and outer body 11 of first bottom cementing plug 10. Inner mandrel 23 passes through outer body 21 of second bottom cementing plug 20, outer body 11 of first bottom cementing plug 10, and baffle adapter 40, falling onto a bypass baffle installed above the float valve or, alternatively, into perforated catcher tube 42. In either case, optional longitudinal slots 27 in nose 25 of inner mandrel 23 may assure that inner mandrel 23 does not substantially undesirably interfere with fluid flow.

When a desired volume of cement slurry has been placed into the work string, operating personnel release a releasing device at the trailing edge of the cement slurry. In certain exemplary embodiments, the releasing device may be a positive displacement device, such as a latch-down type dart. In certain other exemplary embodiments, other types of releasing devices may be used, including but not limited to a weighted ball. The releasing device may be pumped down through the work string at the trailing edge of the cement slurry. The device will interact with inner bore 39 of inner sleeve 33 of top cementing plug 30, which inner bore 39 may in certain exemplary embodiments be tapered, so as to provide a sort of seat for the releasing device. Fluid flow is interrupted, and the resulting pressure increase signals operating personnel that the trailing edge of the cement slurry has arrived at the casing. Increasing the differential pressure across seal 100 to a selected fifth differential pressure shears frangible devices 34, releasing inner sleeve 33 in top cementing plug 30. Inner sleeve 33 travels down from a first position to a second, "released" position within outer body 31 of top cementing plug 30, shouldering off at shoulder point 105.

Optionally, a variety of "secondary" releasing mechanisms may be employed within top cementing plug 30, to ensure that top cementing plug 30 does not prematurely detach from work string 80 (for example, by accidental, premature shearing of frangible devices 34). Such secondary release mechanisms include, but are not limited to, a collet-type releasing mechanism 35 or a ball-type releasing mechanism 36. For example, in embodiments where collet-type releasing mechanism 35 is used, inner sleeve 33 may travel down to its "released" position such that the upper end of collet fingers 96 are no longer backed by inner sleeve 33, thereby allowing collet fingers 96 to flex inwardly and become disengaged from a collet retainer, which collet retainer may comprise split ring 111 (which retains lobes 95) and outer case 94. The collet retainer is initially in interference fit with lobes 95 at the upper end of collet fingers 96. Generally, inner sleeve 33 remains in sealing contact with the inner bore of the releasing mechanism, and, in certain exemplary embodiments, inner sleeve 33 latches into the second, "released" position by engagement of a lock mechanism 37 into internal upset 115. In certain other exemplary embodiments, not shown on FIG. 1, the lower end of inner sleeve 33 may be configured as collet fingers having a square shoulder at the back of an external upset lobe, wherein such collet fingers may be initially compressed within the minor bore of a collet body, and then, upon being contacted with a releasing device, spring out and latch into internal upset 115.

Upon being released by the shearing of frangible devices 34 (and, by the release of an optional secondary release mechanism where such is used), inner sleeve 33 moves from a first position to a second "released" position, which permits the release of top cementing plug 30 from work string 80. In certain exemplary embodiments, both the releasing device (e.g., a positive displacement dart, for example) and inner sleeve 33 comprise latch-down type devices. For example, inner sleeve 33 may comprise as receiving profile designed so as to accept a latch-down mechanism on a releasing device, as may be seen from the exemplary embodiment illustrated at 180 in FIG. 1. In such exemplary embodiments, top cementing plug 30 remains a pressure barrier, which may be useful should problems be experienced with a float valve, for instance. The cement composition travels down through the casing with top cementing plug 30 at its trailing edge until top cementing plug 30 reaches second bottom cementing plug 20, which had previously in this example reached first bottom cementing plug 10, which had itself previously in this example reached baffle adapter 40. Fluid flow is again interrupted, signaling operating personnel that the trailing edge of the cement composition has arrived at baffle adapter 40.

A two-plug cementing plug system of the present invention may be used for a variety of purposes, including, but not limited to, instances where a calibration of the amount of requisite displacement fluid is not needed, or instances where separation of more than two phases of fluid within the well bore is not needed, for example. Generally, the two-plug cementing plug system may be employed through the use of procedures similar to those described above for the three-plug cementing plug system, except that the step of using a first bottom plug to calibrate the interior volume of the casing, is omitted.

Figure 5:
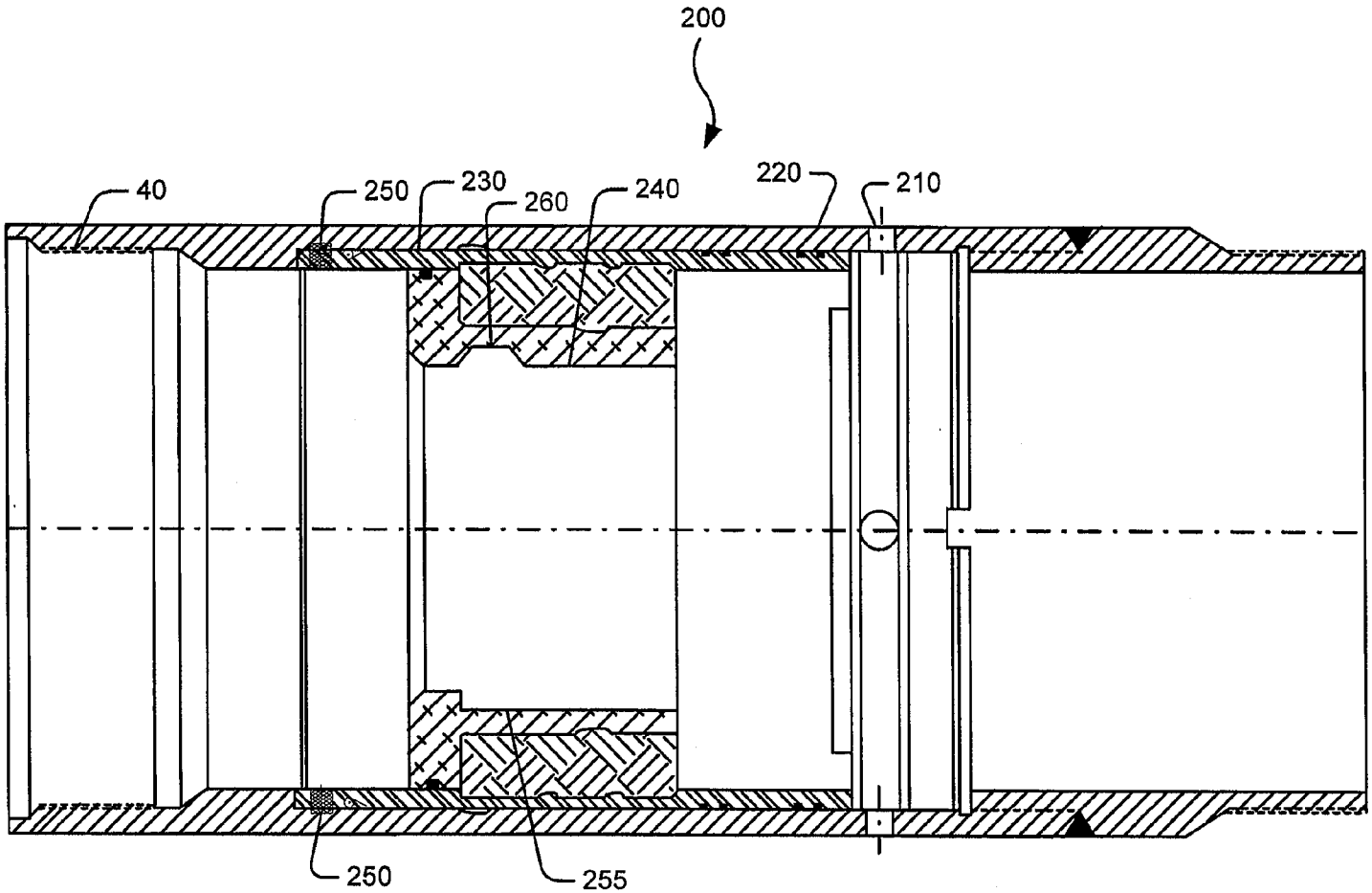
FIG. 5 is a side cross-sectional view of an exemplary embodiment of a ported collar comprising a baffle adapter of the present invention.

Among other uses to which the cementing plug systems of the present invention may be put, certain exemplary embodiments of the cementing plug systems may be used to activate other devices used in subterranean well bores. For example, a baffle adapter, such as baffle adapter 40, may be included within ported collar 200 in the place of a conventional plug seat, as shown in FIG. 5. Ported collar 200 is typically located in the casing string one or more casing joints above the upper-most float valve, and comprises exposed ports 210 through side wall 220, which ports 210 may permit fluid flow when opened so as to allow the casing to rapidly fill to reduce ram effects during casing installation in tight hole conditions. In certain exemplary embodiments, such ported collar 200 will further comprise inner sliding sleeve 230 located within ported collar 200 above ports 210, which may allow flow through ported collar 200 until a desired time. In certain exemplary embodiments, flow is allowed through ports 210 until such time as a bottom plug is landed to "close" the collar and direct all further flow down through the casing and out around the shoe. In certain exemplary embodiments, inner sliding sleeve 230 would generally comprise inner bore 240. In certain exemplary embodiments, inner bore 240 may be configured so as to provide a "seat" for a bottom cementing plug. Inner bore 240 may optionally be configured in certain exemplary embodiments so as to comprise a unique receiving profile (such as single lobe unique receiving profile 260, for example, which is illustrated in the upper half of FIG. 5), designed to permit a particular releasing device (e.g., a dart having a nosepiece comprising a matching unique key profile) to locate and lock within it. In certain other exemplary embodiments, inner bore 240 may optionally be configured with a receiving profile designed so as to accept a latch-down mechanism on a releasing device (such as a dart having a nosepiece comprising a self-energized "C" ring, for example); an example of such receiving profile may be seen in the lower half of FIG. 5, at 255. Inner sliding sleeve 230 may be attached to ported collar 200 by, for example, frangible device 250. A cementing plug of the present invention (comprising a detachable inner mandrel attached to the outer body of the plug by a frangible device or the like) may be landed on baffle adapter 40 within ported collar 200 so as to seal within the seat provided by inner bore 240. As pressure within the casing increases to a first differential pressure, frangible device 250 within ported collar 200 is sheared, thereby displacing inner sliding sleeve 230 within ported collar 200 so as to seal off ports 210 in the side wall. As pressure within the casing increases to a second differential pressure, the frangible device attaching the inner mandrel to the cementing plug is sheared, displacing the inner mandrel and permitting fluid flow to resume through the cementing plug.

While the use of the cementing plugs of the present invention in sub-surface release applications has been described, other embodiments of the present invention may advantageously employ these cementing plugs as conventional surface-release plugs. For example, a surface-launched bottom cementing plug comprising a detachable inner mandrel in conjunction with a baffle adapter and bypass baffle of the present invention may prove particularly useful in horizontal well applications, to mitigate potential problems with the accumulation of a bed of solids in the horizontal section of the well. Among other benefits, surface launched bottom cementing plugs with detachable inner mandrels may be useful to an operator in applications where it is desirable to employ a bottom cementing plug that may be modified at the surface to perform a particular function as needed; such modifications may comprise replacing a frangible device installed in such bottom cementing plug that shears at a particular pressure with a frangible device that shears at a different pressure more suitable for the particular task to be performed.

Therefore, the present invention is well-adapted to carry out the objects and attain the ends and advantages mentioned as well as those which are inherent therein. While the invention has been depicted, described, and is defined by reference to exemplary embodiments of the invention, such a reference does not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. A method of activating a device in a subterranean well bore, the device comprising a baffle adapter configured to achieve sealing contact with a cementing plug, the cementing plug comprising an outer body and a detachable inner mandrel attached to the outer body, comprising:

displacing the cementing plug into contact with the baffle adapter so that the outer body of the cementing plug achieves sealing contact with the baffle adapter; and applying a first differential pressure across the cementing plug, thereby activating the device.

2. The method of claim 1 wherein the device has a length, wherein the device further comprises:

ports disposed along its length; and an inner sliding sleeve;

and wherein activating the device comprises displacing the inner sliding sleeve to seal off the ports such that fluid is prohibited from flowing through the ports.

3. The method of claim 1 further comprising the step of applying a second differential pressure across the detachable inner mandrel, thereby causing the inner mandrel to detach from the outer body of the cementing plug, wherein the second differential pressure is greater than the first differential pressure.

4. The method of claim 3 further comprising the step of catching the detached inner mandrel in a perforated catcher tube.

5. The method of claim 3 further comprising the step of restraining the detached inner mandrel with a float valve installed in the casing string.

6. The method of claim 3 further comprising the step of restraining the detached inner mandrel with a bypass baffle installed in the casing string.

7. The method of claim 3 wherein outer body comprises an inner bore, and wherein the detachment of the inner mandrel from the outer body permits fluid flow through the inner bore.

8. The method of claim 1 wherein the detachable inner mandrel has a length greater than the diameter of the well bore.

9. The method of claim 1 wherein the cementing plug comprises a latch-down mechanism, and wherein a portion of the baffle adapter comprises a receiving profile configured to accept the latch-down mechanism.

10. The method of claim 1 wherein the plug comprises a unique key profile, and wherein a portion of the baffle adapter comprises a matching unique receiving profile.

11. A baffle adapter, comprising an inner bore designed to engage and seal against the outer body of a plug, the plug comprising an outer body and a detachable inner mandrel attached to the outer body;

wherein the inner mandrel detaches from the outer body upon application of a selected pressure; and wherein the inner bore is tapered.

12. The baffle adapter of claim 11 wherein the baffle adapter comprises a perforated catcher tube.

13. The baffle adapter of claim 11 further comprising an extended length insert.

14. A baffle adapter, comprising an inner bore designed to engage and seal against the outer body of a plug, the plug comprising an outer body and a detachable inner mandrel attached to the outer body;

wherein the inner mandrel detaches from the outer body upon application of a selected pressure; and wherein the inner bore has an inner diameter, and wherein the inner diameter is in the range of from about 70% to about 90% of the inner diameter of a casing string into which the baffle adapter may be placed.

* * * * *